United States Patent [19]

Benin et al.

[11] Patent Number: 5,009,942

[45] Date of Patent: Apr. 23, 1991

[54] VORTEXING LIQUID CONTAINER

[75] Inventors: Joshua Benin, Newark, Del.; William G. Di Maio, Brookhaven, Pa.; Carl F. Morin, Brandywood, Del.; James A. Lawler, Rio Piedras, P.R.

[73] Assignee: E. I. Du Pont de Nemours and Company, Wilmington, Del.

[21] Appl. No.: 237,589

[22] Filed: Aug. 26, 1988

[51] Int. Cl.[5] ..... B01C 3/00

[52] U.S. Cl. ..... 428/36.6; 220/500; 422/102; 428/36.7

[58] Field of Search ..... 220/339, 400, 20; 428/36.6, 36.7; 422/102

[56] References Cited

U.S. PATENT DOCUMENTS

| | | | |
|---|---|---|---|
| 3,850,580 | 11/1974 | Moore et al. | 23/259 |
| 4,555,183 | 11/1985 | Thomas | 336/208 |
| 4,717,018 | 1/1988 | Sacherer et al. | 220/339 |
| 4,720,374 | 1/1988 | Ramachandran | 422/310 |
| 4,724,979 | 2/1988 | Cleevely et al. | 220/339 |

*Primary Examiner*—James J. Seidleck

[57] ABSTRACT

A nutatable plastic vessel, having a protuberant tip at its bottom end, has its side wall connected by a plastic hinge to a housing.

9 Claims, 2 Drawing Sheets

VORTEXING LIQUID CONTAINER

CROSS REFERENCE TO RELATED APPLICATIONS

Subject matter disclosed herein is disclosed or claimed in the following copending applications filed contemporaneously herewith: Lid Structure filed Aug. 26, 1988, Ser. No. 07/237,011, U.S. Pat. No. 4,935,274; Vortex Mixer Drive filed Aug. 24, 1986, Ser. No. 07/237,017, U.S. Pat. No. 4,895,453; and Automatic Vortex Mixer filed Aug. 26, 1988, Ser. No. 07/237,254, U.S. Pat. No. 4,848,917.

The subject matter disclosed herein is disclosed and claimed in the following copending application: Resealable Lid for a Container, filed July 22, 1985, Ser. No. 06/757,575, U.S. Pat. No. 4,847,050.

FIELD OF THE INVENTION

The present invention relates to a reagent holder having a compartment that facilitates the noninvasive mixing of fluids.

BACKGROUND OF THE INVENTION

It is known that creating a vortex in the fluid contained in a vessel or compartment is an effective means for mixing the contents of the vessel. Common laboratory vortexers use a support cup or a resilient vessel receiving surface mounted eccentrically on a motor in order to translate the lower part of a vessel in a circular path or orbit at a high speed and thereby create an effective vortex in the fluid contained in the vessel. Exemplary of this type of device are those disclosed in U.S. Pat. No. 4,555,183 (Thomas) and U.S. Pat. No. 3,850,580 (Moore et al.). These devices are manual in that an operator is required to hold the vessel in contact with the eccentrically movable means to create the vortex in the fluid disposed in the vessel.

Such vortex type mixer would be extremely advantageous in an automated chemical analysis instrument as it is noninvasive and therefore avoids the concern of contamination associated with an improperly cleaned invasive mixing means.

Unfortunately, when the bottom of a vessel or compartment is orbited to create a vortex, it is difficult to maintain the vessel's lid structure sealed. This is particularly true when there are multicompartments and one is orbited while the remainder remain stationary.

Often some of the reagents held in the various compartments are in the form of tabletted reagents which must be hydrated. It is known to utilize ultrasonic energy to facilitate the hydration or dissolving process. One such sonication technique is described in U.S. Pat. No. 4,720,374 issued Jan. 19, 1988 to Ramachandran. While entirely a satisfactory procedure, the application of ultrasonic energy is somewhat costly.

It is desirable in such automated chemical analyzers to store several reagents in contiguous common reagent vessels. Such a common multivessel container is sold today in an instrument known as the Dimension Chemical Analyzers by E. I. du Pont de Nemours and Company, Wilmington, Del. Such strip is described in Ramachandran. This common container is in the form of a container strip which includes a rigid peripheral band formed of an inert plastic. The band is either joined to or formed integrally with each of the vessels such that the container strip generally tapers in a substantially elongated wedge-like manner from a first edge to a second edge. The wedge-shaped plan profile for the container strip facilitates the mounting of a plurality of such strips in a circumferentially adjacent, generally radially extending relationship across a rotatable reagent carrying plate. The tops of the vessels are sealed with a suitable laminate that prevents gas and vapor escape and yet permits penetration by a probe for aspiration, etc. The plastic used for the Dimension TM receptacle is polyethylene and the laminate is a three-ply laminate of a polyester film, a polyvinylidene coating on the polyester film, and finally a sheet of polyethylene which is adhered to the coating. The laminate is sealed to the peripheral surface of the polyethylene vessels with the polyethylene sheet contacting the vessel rims.

These prior art multivessel containers do not facilitate vortex mixing of only one of the several vessels comprising the container.

When storing a liquid reagent or specimen, care must be exercised to minimize evaporation. Simultaneously, however, whatever structure is used to inhibit evaporation must be compatible with the requirements of access to the liquid as by an aspirating probe during use. The Ramachandran patent describes such a lid which reduces air and vapor transmission through the top of the lid. By isolating the vessels and thereby forming multivessel containers, contamination between vessels is also reduced.

The lid structure described by Ramachandran is formed of conjoined upper and lower sheets of material. One of the sheets has a receptacle formed therein which receives an elastomeric self-healing pad. A portion of the conjoined first and second sheets forms a sealing flange which completely surrounds the periphery of the receptacle and which provides a surface whereby the lid may be secured by the container.

SUMMARY OF THE INVENTION

Many of these problems of automatically mixing materials in the prior art reagent containers are solved by forming a vessel whose top portion is flexibly held and whose bottom portion is permitted to be nutated about the axis of the vessel to establish vortex mixing therein. According to a preferred embodiment of this invention, there is provided a housing for an elongated vessel having a side wall and a longitudinal axis, the vessel being plastic and having a peripheral mounting surface, the housing comprising: a flexible hinge connecting the housing to the side wall of the vessel and being integral with both the housing and vessel, and a plastic laminate, providing a gas and vapor seal, connected to the mounting surface.

Preferably the plastic used to form the compartment is polypropylene since this provides a flexible hinge having a relatively long life. The laminate, providing the gas and vapor seal, is a three-ply laminate of a polyester film, a polyvinylidene coating on the polyester film, and a sheet of the polypropylene adhered to the coating, the laminate being heat sealed to the peripheral surface with the polypropylene sheet connected to the surface. Preferably the hinge is positioned below the mounting surface so that it does not interfere with the nutational movement of the vessel and so that its mechanical properties are not altered by the lid heat sealing process. The vessel defines a protuberant bottom tip portion lying along the longitudinal axis. This facilitates engaging the bottom of the vessel for nutational movement.

In a preferred embodiment the housing, which may support additional containers, as well as the vessel, has a peripheral mounting surface. Both mounting surfaces lie in the same plane and the laminate is connected to both mounting surfaces but is slit in the region immediately surrounding the rim of the vessel. This facilitates the nutation of the vessel's lower end and helps to prevent such nutational movement from disturbing the seal at the peripheral surface of the vessel.

BRIEF DESCRIPTION OF THE DRAWINGS

The invention may be more fully understood from the following detailed description thereof taken in connection with the accompanying drawings which form a part of this application and in which similar reference numbers refer to similar elements in all figures of the drawings in which.

DETAILED DESCRIPTION OF THE INVENTION

Figure 1:
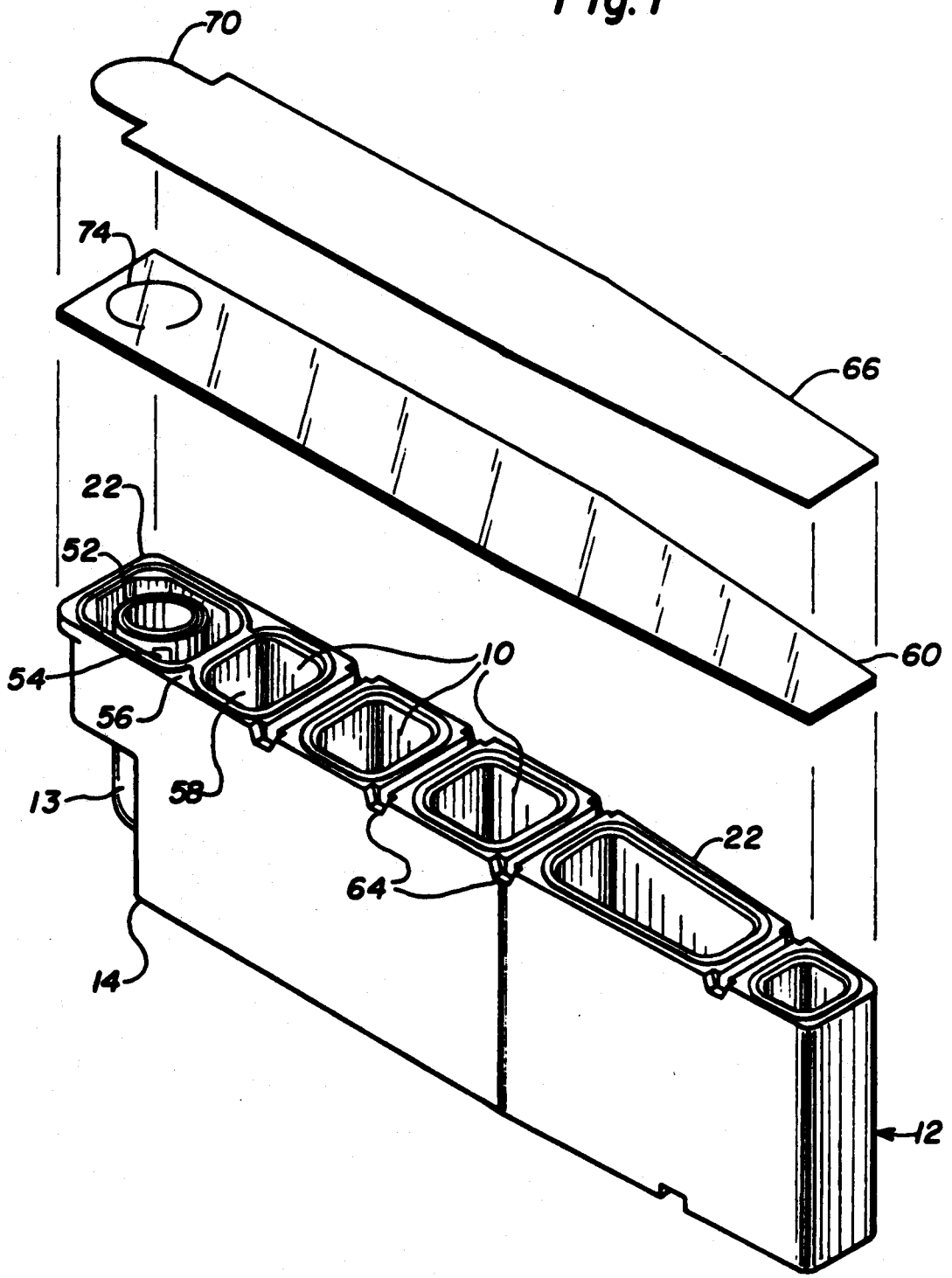
FIG. 1 is an exploded view of the multicontainer strip that is useful for carrying liquids for chemical testing in which each container defines a compartment capable of holding reagents in either liquid or lyophilized (tabletted) form.
Figure 2:
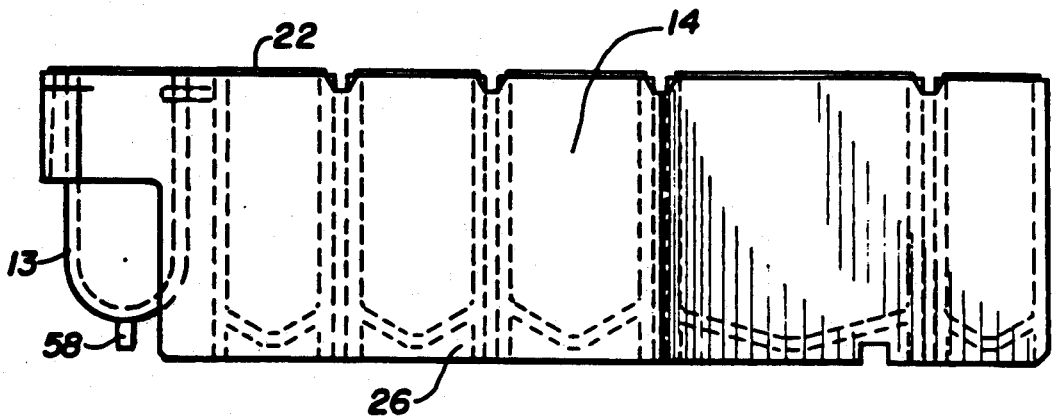
FIG. 2 is a side elevation view of the multicontainer strip of FIG. 1.
Figure 3:
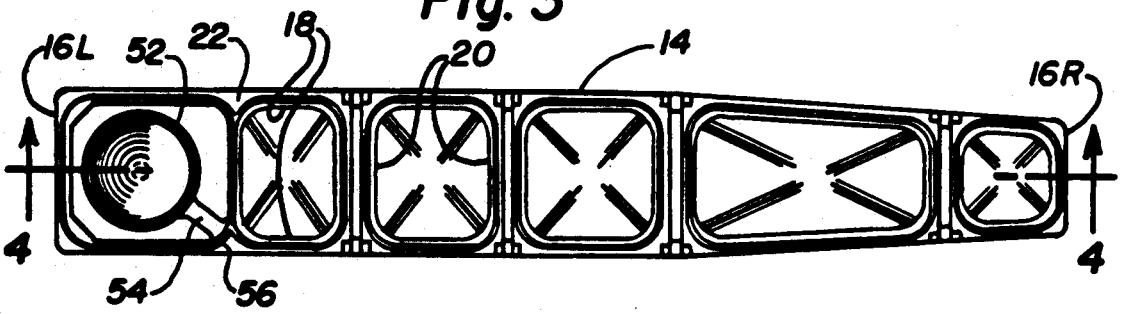
FIG. 3 is a plan view of the multicontainer strip depicted in FIG. 1.
Figure 4:
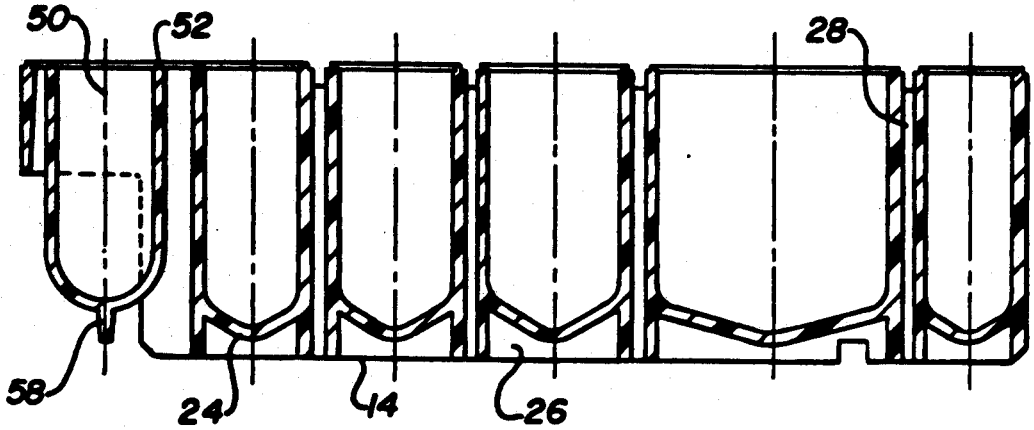
FIG. 4 is a cross-sectional side elevational view of the multicompartmented strip taken through the sectional line 4—4 of FIG. 3.

As may be seen in FIG. 1 a plurality of containers 10 are arranged in an end to end relationship to form a container strip generally indicated by the reference character 12. The container strip 12 may be fabricated in any convenient manner. In the embodiment shown, the container strip 12 includes a rigid housing or peripheral band 14 formed of a suitable material such as an inert plastic. The band 14 is either joined to or preferably is formed integrally with each of the containers 10 such that in the preferred case the container strip 12 generally tapers in a substantially elongated wedge-like manner from a first edge 16L to a second edge 16R. This wedge-shaped plan profile for the container strip 12 facilitates the mounting of a plurality of such strips in a circumferentially adjacent, generally radially extending relationship across a rotatable reagent carrying plate. A plate of this type is disclosed in the analysis instrument disclosed in copending application Ser. No. 139,108, filed Dec. 23, 1987, U.S. Pat. No. 4,863,693 entitled "Analysis Instrument Having Heat-Formed Analysis Cuvettes" (Ip-0473-A). Such usage is also described in copending application entitled "Method and Apparatus for Effecting the Automatic Analytical Testing of Samples, Ser. No. 07/237,119, filed Aug. 26, 1988. It should be appreciated however that the individual containers may take any predetermined configuration and may be used alone or arranged together in any convenient number and in any convenient manner and remain within the contemplation of this invention.

As is described in the '374 patent, each of the containers 10 can either be arranged singularly or in a container strip 12 and is formed of a suitable inert plastic material and includes a compartment defined by generally opposed pairs of generally parallel and integrally formed side walls 18 and endwalls 20. The upper surfaces of the side walls 18 and the endwalls 20 together with the upper surface of the band 14 and the vicinity thereof register to define a substantially planar sealing surface 22 peripherally surrounding the open upper end of the containers 10. In accordance with this invention, one of the containers 10 is a vortexing vessel 13. Each of the containers 10 except for this vortexing vessel is closed by a downwardly sloping inverted pyramidal floor 24.

The side walls 18 of each container 10 except for the vortexing vessel 13 are joined to the peripheral band 14. The band 14 extends sliqhtly below the lower ends of the containers 10 and thus defines a support structure 26 whereby the strip may be set on a suitable work surface. The several containers 10 may be arranged in various configurations square, rectangle, etc.

Each of the adjacent containers 10 are spaced from each other by a predetermined gap 28 to enhance the thermal and vapor isolation of each of the containers 10, preferably the container strip 12 is formed by injection molding and is formed of polypropylene. Alternatively polyethylene or other suitable materials of construction may be used however polypropylene is preferred because of its ability to be flexed many times and not break.

In accordance with this invention the end or vortexing vessel 13 is tubular and elongated and has a longitudinal axis 50. The vessel 13 also has a rim 52 which defines a peripheral mounting surface similar to the peripheral mounting surfaces provides by the containers 10 and the band 14. The vessel 13 is connected to the band 14 by an integral, flexible thin finger of plastic thus forming a flexible hinge 54. The flexible hinge 54 is directed to a corner 56 formed by the band 14 and the end container 58. The hinge 54 is located just below the rim 52 such that it does not interfere the vapor seal which is placed on top of the vessel 13 and the containers 10 and so that its mechanical properties are not affected by the lid heat sealing process.

The bottom of the vessel 13 is formed to have a downwardly extending protuberant tip portion 58 which is adapted to being engaged by an eccentric or orbiting type drive to create nutational movement of its bottom portion, the vessel 13 pivoting about the flexible hinge 54. The lower portion of the band 14 is removed to form a short skirt about the vessel 13 such that the vessel 13 is free for such nutational movement at its lower portion.

A suitable drive for the protuberant tip 58 to provide such nutational motion is described in copending application Ser. No. 07/237,254, filed abandoned Aug. 28, 1988 and entitled "Automatic Vortex Mixer". An alternative drive that may be used is that described in an article by Wada et al. Automatic DNA Sequencer: Computer-programmed microchemical manipulator for the Maxam-Gilbert sequencing method, Rev. Sci. Instram., 54 (11). 1969–72. Since the particular drive does not form a part of this invention, it will not be described further except to say that the function of the drive is to engage the protuberant tip and move it in an nutational, or orbital type movement so as to establish vortex mixing within the vessel 13.

While the vessel may be left open if desired, for the reasons previously stated, when reagents are stored therein it is best that a vapor barrier and a rehealable sheet be used to afford plural piercings by a probe for withdrawal of the reagent. For this reason, a three-ply laminate 60 is heat-sealed to the peripheral mounting surfaces of the containers 10 as well as the vessel 13 and the band 14 particularly where it forms a skirt about the rim 52 of the vessel 13.

To facilitate sealing of the individual compartments, a small notch 64 is formed in the molding process between each container but for the container adjacent the vessel 13. Finally, a self-healing lid structure 66 is adhered to the laminate 60. The self-healing structure 66 may be any of the elastomers that are chemically inert. It is preferred however that a silicon rubber sheet, having a thickness of 32 mils, sold by CHR Industries be used. It is applied to the laminate 60 with a suitable adhesive such as that as available from the General Electric Company of waterford. NY having a product identification of TSA6574 which is a silicone resin which uses a primer solution having a product identification of SR500. The end of the lid structure 66 which is over the vessel 13 has its exterior cutaway forming a semicircular end having the same diameter and width as that of the vessel 13. Further, the laminate 60 is slit immediately about the rim 52, prior to application of the lid structure 66, to facilitate the nutational movement of the compartment 12 without disturbing the seals.

The laminate closes each of the containers with an impermeable seal so as to form an evaporation barrier for the contents of the vessel 13 and the containers 10 and to isolate the compartment and containers against vapor cross contamination and isolate the containers from contaminating gasses such as carbon dioxide or oxygen.

Since the laminate 60 is heat sealed to the mounting surfaces surrounding each container 10, the rim 52 of the vessel 13, and the strip, the material of the lower ply must be heat sealable to the plastic forming the strip 14. In its preferred embodiment the laminate 60 is three-ply laminate with the outer layer a polyester film such as that sold by E. I. du pont de Nemours and Company under the trademark Mylar®, a polyvinylidene chloride coating on the polyester film such as that sold by Dow Chemical Co. under the trademark Saran®, and finally an outer barrier sheet of polypropylene since the strip is made of polypropylene. If the strip were made of polyethylene this lower laminate would be polyethylene.

The lid structure 66 may be provided with slits to facilitate the insertion of probes into the vessel 13 and containers 10. The use of the silicon rubber, which is a self-healing elastomer, provides a wiping action on the probe, does not tend to stick to the probe, is not easily cored.

The seal is not disturbed by the nutational movement of the vessel 13. Such nutational movement is particularly facilitated by the slitting of the laminate about the top rim 52 of the vessel. The flexible hinge 54 has a relatively long life and hence permits significant nutational movement of the vessel.

We claim:

1. A housing encasing an elongated vessel, said vessel having a bottom, a side wall and a longitudinal axis, the vessel being plastic and having a peripheral mounting surface, the housing comprising:

a flexible, fingerlike hinge connecting the housing to a side wall of the vessel and integral with both the housing and vessel, whereby the vessel bottom is capable of nutational movement about the axis, and a laminate, providing a gas and vapor seal, connected to the mounting surface.

2. A housing as set forth in claim 1 wherein the vessel is polypropylene and the laminate is a three ply laminate of a polyester film, a polyvinylidene coating on the polyester film, and a sheet of the polypropylene adhered to the coating, the laminate being sealed to the peripheral surface with the polypropylene sheet connected to the surface.

3. A housing as set forth in claim 2 wherein the hinge is positioned below the mounting surface.

4. A housing as set forth in claim 3 wherein the housing surrounds the vessel about the upper portion of the side walls coaxially to the longitudinal axis leaving the vessel lower portion easily accessible.

5. A housing as set forth in claim 4 wherein the vessel defines a protuberant tip portion lying on the longitudinal axis and extending downwardly from the vessel.

6. A housing as set forth in claim 1 wherein the hinge is positioned below the mounting surface.

7. A housing as set forth in claim 1 wherein the housing has a peripheral mounting surface, the vessel and housing mounting surfaces defining a common plane, the laminate also being connected to the housing peripheral mounting surface and being slit in the region immediately surrounding the vessel, thereby to facilitate nutation of the lower end of the vessel.

8. A housing as set forth in claim 7 wherein the hinge is positioned below the mounting surface.

9. A housing as set forth in claim 8 wherein the housing also defines a container having a peripheral mounting surface lying in the said, plane, the container being located separate from but contiguous the vessel, the laminate also being connected to the container peripheral surface.

* * * * *